US009291926B2

(12) United States Patent
Fukuri et al.

(10) Patent No.: US 9,291,926 B2
(45) Date of Patent: Mar. 22, 2016

(54) METHOD FOR PRODUCING TONER FOR ELECTROSTATIC IMAGE DEVELOPMENT

(71) Applicant: Kao Corporation, Chuo-ku (JP)

(72) Inventors: Norihiro Fukuri, Wakayama (JP); Eiji Shirai, Wakayama (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 14/265,822

(22) Filed: Apr. 30, 2014

(65) Prior Publication Data

US 2014/0363765 A1 Dec. 11, 2014

(30) Foreign Application Priority Data

Jun. 7, 2013 (JP) ..... 2013-120539

(51) Int. Cl.
*G03G 9/087* (2006.01)
*G03G 9/08* (2006.01)

(52) U.S. Cl.
CPC ..... *G03G 9/081* (2013.01); *G03G 9/08755* (2013.01); *G03G 9/08795* (2013.01); *G03G 9/08797* (2013.01)

(58) Field of Classification Search
CPC ..... G03G 9/0806; G03G 9/08755; G03G 9/08757
See application file for complete search history.

(56) References Cited

U.S. PATENT DOCUMENTS

| | | | | |
|---|---|---|---|---|
| 2006/0078816 | A1* | 4/2006 | Uosaki et al. | 430/111.1 |
| 2006/0167214 | A1* | 7/2006 | Terauchi et al. | 528/272 |
| 2012/0189956 | A1* | 7/2012 | Chen et al. | 430/137.14 |
| 2012/0258392 | A1* | 10/2012 | Murata et al. | 430/105 |

FOREIGN PATENT DOCUMENTS

| | | | |
|---|---|---|---|
| JP | 2004-126545 | A | 4/2004 |
| JP | 2004-280084 | A | 10/2004 |
| JP | 2012-194259 | A | 10/2012 |

* cited by examiner

*Primary Examiner* — Peter Vajda
(74) *Attorney, Agent, or Firm* — Oblon, McClelland, Maier & Neustadt, L.L.P.

(57) ABSTRACT

A method for producing a toner for electrostatic image development, including the steps of (1) polycondensing an alcohol component, a carboxylic acid component, and polyethylene terephthalate to provide an amorphous polyester; and (2) subjecting the amorphous polyester obtained in the step (1) and components containing a crystalline polyester in an amount of from 0.3 to 2.5 times the mass of the components derived from the polyethylene terephthalate in the amorphous polyester to a process for producing a toner. The toner for electrostatic image development obtained by the method of the present invention is suitably used in development or the like of latent images formed in, for example, an electrophotographic method, an electrostatic recording method, an electrostatic printing method, or the like.

20 Claims, No Drawings

METHOD FOR PRODUCING TONER FOR ELECTROSTATIC IMAGE DEVELOPMENT

CROSS REFERENCES TO RELATED APPLICATIONS

This application claims priority to Japanese Patent Application No. 2013-120539, filed on Jun. 7, 2013.

FIELD OF THE INVENTION

The present invention relates to a resin binder composition for use in a toner usable in developing latent images formed in, for example, an electrophotographic method, a method for producing the resin binder composition for use in a toner, and a toner for electrostatic image development containing the resin binder composition.

BACKGROUND OF THE INVENTION

In the field of electrophotography, with the development of electrophotographic systems, the development of a toner for electrophotography meeting the needs of high-image qualities and speeding-up is in demand.

In order to improve especially thermal properties for meeting the needs of high-image qualities and high speeds, polyester resins of which components are easily adjusted are widely used as resin binders for toners, and further plural resins are tried to used.

For example, Japanese Patent Laid-Open No. 2012-194259 discloses a resin binder for a toner, containing a crystalline polyester obtained by polycondensing an alcohol component containing a linear aliphatic diol having from 2 to 10 carbon atoms, and a carboxylic acid component containing a sebacic acid compound in an amount of from 90.0 to 99.8% by mol, and a 1,9-nonanedicarboxylic acid compound and a 1,10-decanedicarboxylic acid compound in a total amount of from 0.2 to 2.0% by mol, for the purposes of improving low-temperature fusing ability, storage property, and durability.

Also, Japanese Patent Laid-Open No. 2004-280084 discloses a toner for electrostatic image development containing a resin binder and a colorant, wherein the resin binder contains two kinds of resins of which softening points differ by 10° C. or more, wherein a resin having a higher softening point is a polyester obtained by reacting a polyethylene terephthalate or a modified polyethylene terephthalate, an alcohol component, and a carboxylic acid component, or a hybrid resin containing the above polyester as one of the resin components, for the purposes of improving low-temperature fusing ability, offset resistance, durability during high-speed printing.

Japanese Patent Laid-Open No. 2004-126545 (U.S. Patent Application Publication No. 2006/0167214) discloses a resin binder for a toner having a polyester structure, characterized in that the structural unit of bisphenol A is contained in an amount of 1% by mol or less of the structural units derived from all the alcohols, that a content proportion of tin is 5 ppm or less, and that a content proportion of an element such as titanium is from 10 to 1,500 ppm, and further that the polyester is obtained by reacting a polyethylene terephthalate, a polycarboxylic acid, and a polyhydric alcohol in the presence of a titanium catalyst or the like, for the purposes of improving low-temperature fusing ability, offset resistance and anti-smearing property.

SUMMARY OF THE INVENTION

The present invention relates to a method for producing a toner for electrostatic image development, including the steps of:

(1) polycondensing an alcohol component, a carboxylic acid component, and polyethylene terephthalate to provide an amorphous polyester; and (2) subjecting components containing the amorphous polyester obtained in the step (1) and a crystalline polyester, the crystalline polyester in an amount of from 0.3 to 2.5 times the mass of a component derived from the polyethylene terephthalate in the amorphous polyester to a process for producing a toner.

DETAILED DESCRIPTION OF THE INVENTION

In electrophotographic method, the development of toners having a wide non-offset region and even more excellent low-temperature fusing ability is in demand, and especially in high-speed machines, the amount of energy transmitted to the toner becomes small relative to the temperatures of the fusing apparatus, so that further improvements in low-temperature fusing ability are in demand. In order to improve low-temperature fusing ability, a method of regulating melting behaviors by including a wax, a crystalline polyester or the like in a toner is being employed. However, the toner that is more likely to be melted is disadvantageous in heat-resistant storage property and durability. Therefore, toners satisfying low-temperature fusing ability with heat-resistant storage property and durability are in demand.

The present invention relates to a binder resin composition for use in a toner capable of satisfying low-temperature fusing ability with heat-resistant storage property and durability of the toner obtained, a method for producing the resin binder composition, and a toner for electrostatic image development containing the resin binder composition.

As a result of the studies that the factors influencing low-temperature fusing ability, heat-resistant storage property, and durability of the toner are considered to be attributable to the states of the resins in the resin binders contained in the toner, the present inventors have found that when mixing an amorphous polyester obtained from a polyethylene terephthalate as a raw material, and a crystalline polyester, the toner obtained exhibits excellent low-temperature fusing ability, heat-resistant storage property, and durability. The present invention has been perfected thereby.

The resin binder composition for use in a toner of the present invention exhibits some excellent effects that the toner obtained is capable of satisfying low-temperature fusing ability with heat-resistant storage property and durability.

The resin binder composition for use in a toner of the present invention is a resin binder composition for use in a toner containing an amorphous polyester and a crystalline polyester, in which the above amorphous polyester is obtained by reacting a polyethylene terephthalate, an alcohol component, and a carboxylic acid component.

Although not wanting to be limited by theory, the reasons why the toner containing the resin binder composition of the present invention can satisfy low-temperature fusing ability with heat-resistant storage property and durability are not certain, but are considered to be as follows.

The resin binder composition of the present invention contains an amorphous polyester and a crystalline polyester. However, when the compatibility of the amorphous polyester and the crystalline polyester is too high, heat-resistant storage property and durability are worsened even though low-temperature fusing ability is improved.

In the present invention, since a polyethylene terephthalate is used as a raw material of the amorphous polyester, it is considered that the amorphous polyester includes a polyethylene terephthalate moiety in a block form. The polyethylene terephthalate moiety has high hydrophilicity, so that compatibility with a crystalline polyester having a hydrophobic crystalline structure is inhibited, and further the polyethylene terephthalate moiety acts as a crystal nucleus, and thereby it is considered to be made possible to form a fine crystalline moiety derived from the crystalline polyester, whereby it is considered that a toner satisfying low-temperature fusing ability with heat-resistant storage property and durability is obtained.

In the present invention, at least one member of the amorphous polyesters is obtained by reacting an alcohol component, a carboxylic acid component, and a polyethylene terephthalate (PET).

As PET, those produced in accordance with a conventional method, including polycondensing ethylene glycol and terephthalic acid, dimethyl terephthalate or the like can be used. In the present invention, PET is widely used as manufactured articles such as bottles and films, so that those that are once produced as the manufactured articles, discarded, and recycled are preferably used, from the aspects of environmental-friendliness and costs. Here, the kinds or the like of the recycled article are not particularly limited, so long as the recycled article does not contain any compounds that would hamper the performance of the toner or polymerization reaction, and has a certain level of purity.

Here, when using the recycled articles, those pulverized into flaky forms, pellets, and the like are preferably used, from the viewpoint of handleability and facility in dispersion, degradation, or the like.

The PET has a number-average molecular weight of preferably 10,000 or more, more preferably 15,000 or more, and even more preferably 18,000 or more, from the viewpoint of heat-resistant storage property and hot offset resistance. In addition, the PET has a number-average molecular weight of preferably 40,000 or less, more preferably 38,000 or less, and even more preferably 35,000 or less, from the viewpoint of low-temperature fusing ability.

The amount of the PET subjected to the reaction of a total amount of the alcohol component, the carboxylic acid component, and the polyethylene terephthalate is preferably 3% by mass or more, more preferably 5% by mass or more, and even more preferably 8% by mass or more, from the viewpoint of heat-resistant storage property and pulverizability. In addition, the amount of the PET is preferably 65% by mass or less, more preferably 50% by mass or less, even more preferably 30% by mass or less, and even more preferably 15% by mass or less, from the viewpoint of low-temperature fusing ability.

It is preferable that the alcohol component contains an aromatic diol, from the viewpoint of triboelectric chargeability of the toner.

The aromatic diol includes an alkylene oxide adduct of bisphenol A represented by the formula (I):

(I)

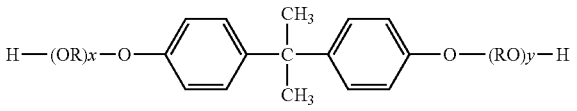

wherein RO is an alkylene oxide, wherein R is an alkylene group having 2 or 3 carbon atoms; and each of x and y is a positive number showing an average number of moles of alkylene oxide added, wherein the sum of x and y is from 1 to 16, and preferably from 1.5 to 5.0, from the viewpoint of heat-resistant storage property and triboelectric chargeability of the toner. The alkylene oxide adduct of bisphenol A represented by the formula (I) includes polyoxypropylene(2.2)-2,2-bis(4-hydroxyphenyl)propane, polyoxyethylene(2.2)-2,2-bis(4-hydroxyphenyl)propane, and the like.

The content of the aromatic diol is preferably from 50 to 100% by mol, more preferably from 60 to 100% by mol, and even more preferably from 80 to 100% by mol, of the alcohol component.

The alcohol other than the aromatic diol includes dihydric alcohols such as 1,2-propylene glycol, 1,4-butanediol, neopentyl glycol, polyethylene glycol, polypropylene glycol, and hydrogenated bisphenol A; trihydric or higher polyhydric alcohols such as sorbitol, pentaerythritol, glycerol, and trimethylolpropane, and the like.

In the carboxylic acid component, the dicarboxylic acid compound includes aromatic dicarboxylic acids such as phthalic acid, isophthalic acid, and terephthalic acid; aliphatic dicarboxylic acids, such as oxalic acid, malonic acid, maleic acid, fumaric acid, citraconic acid, itaconic acid, glutaconic acid, succinic acid, adipic acid, and a succinic acid substituted with an alkyl group having 1 to 20 carbon atoms or an alkenyl group having 2 to 20 carbon atoms, such as dodecenylsuccinic acid and octylsuccinic acid; acid anhydrides thereof, lower alkyl (1 to 3 carbon atoms) esters thereof, and the like.

It is preferable that the carboxylic acid component contains an aromatic dicarboxylic acid compound, from the viewpoint of triboelectric chargeability and heat-resistance storage property of the toner. The content of the aromatic dicarboxylic acid compound is preferably from 15 to 70% by mol, more preferably from 20 to 60% by mol, and even preferably from 25 to 50% by mol, of the carboxylic acid component, from the viewpoint of triboelectric chargeability and heat-resistance storage property of the toner.

The tricarboxylic or higher polycarboxylic acid compound includes, for example, 1,2,4-benzenetricarboxylic acid, i.e. trimellitic acid, 2,5,7-naphthalenetricarboxylic acid, pyromellitic acid, acid anhydrides thereof, lower alkyl (1 to 3 carbon atoms) esters thereof, and the like.

The content of the tricarboxylic or higher polycarboxylic acid compound is preferably 15% by mol or more, and more preferably 20% by mol or more, of the carboxylic acid component, from the viewpoint of hot offset resistance of the toner. Also, the content of the tricarboxylic or higher polycarboxylic acid compound is preferably 80% by mol or less, more preferably 50% by mol or less, even more preferably 40% by mol or less, and even more preferably 30% by mol or less, of the carboxylic acid component, from the viewpoint of low-temperature fusing ability.

The alcohol component may properly contain a monohydric alcohol, and the carboxylic acid component may properly contain a monocarboxylic acid compound.

The temperature during the polycondensation reaction is preferably 200° C. or higher, and more preferably 225° C. or higher, from the viewpoint of reactivity. In addition, the temperature is preferably 250° C. or lower, from the viewpoint of pyrolysis. Also, the temperature during the polycondensation reaction is preferably from 200° to 250° C., and more preferably from 225° to 250° C.

The polycondensation reaction may be carried out optionally in the presence of an esterification catalyst, an esterification promoter, a polymerization inhibitor, or the like. The esterification catalyst includes tin catalysts, titanium catalysts, and the like. The tin catalysts include dibutyltin oxide, tin(II) 2-ethylhexanoate, and the like, and a tin(II) compound without containing a Sn—C bond, such as tin(II) 2-ethylhexanoate, is preferred from the viewpoint of reactivity, adjustment of molecular weight, and adjustment of physical properties of the resin. The titanium catalysts include titanium diisopropylate bistriethanolaminate and the like. The amount of the esterification catalyst used is preferably from 0.01 to 1.5 parts by mass, and more preferably from 0.1 to 1.0 part by mass, based on 100 parts by mass of a total amount of the alcohol component and the carboxylic acid component. The esterification promoter includes gallic acid, and the like. The amount of the esterification promoter used is preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The amount of the polymerization inhibitor used is preferably from 0.001 to 0.5 parts by mass, and more preferably from 0.01 to 0.1 parts by mass, based on 100 parts by mass of a total amount of the alcohol component and the carboxylic acid component.

The amorphous polyester has a softening point of preferably 80° C. or higher, and more preferably 100° C. or higher, from the viewpoint of heat-resistant storage property and pulverizability. In addition, the amorphous polyester has a softening point of preferably 170° C. or lower, and more preferably 130° C. or lower, from the viewpoint of low-temperature fusing ability. When the amorphous polyester is composed of two or more kinds of polyesters, it is preferable that a weighted average thereof is within the above range.

It is preferable that the amorphous polyester is composed of two kinds of amorphous polyesters having different softening points, from the viewpoint of hot offset resistance and low-temperature fusing ability. At least one of the polyesters is an amorphous polyester obtained from using a PET, and it is preferable that an amorphous polyester having a higher softening point is an amorphous obtained from using a PET, and that an amorphous polyester having a lower softening point is an amorphous polyester obtained without using a PET.

The resin having a lower softening point has a softening point of preferably 80° C. or higher, and more preferably 85° C. or higher, and a softening point of preferably 110° C. or lower, and more preferably 100° C. or lower. The resin having a higher softening point has a softening point of preferably 120° C. or higher, and more preferably 130° C. or higher, and a softening point of preferably 170° C. or lower, and more preferably 150° C. or lower.

A mass ratio of the resin having a higher softening point to the resin having a lower softening point, i.e. the resin having a higher softening point/the resin having a lower softening point, is preferably from 50/50 to 90/10, and more preferably from 60/40 to 80/20, from the viewpoint of heat-resistant storage property, durability, and pulverizability of the toner.

The amorphous polyester has a glass transition temperature of preferably 45° C. or higher, and more preferably 50° C. or higher, from the viewpoint of heat-resistant storage property. In addition, the amorphous polyester has a glass transition temperature of preferably 63° C. or lower, and more preferably 58° C. or lower, from the viewpoint of low-temperature fusing ability.

The amorphous polyester has an acid value of preferably 15 mgKOH/g or more, and more preferably 20 mgKOH/g or more, from the viewpoint of triboelectric chargeability of the toner. In addition, the amorphous polyester has an acid value of preferably 40 mgKOH/g or less, and more preferably 30 mgKOH/g or less, from the viewpoint of hygroscopicity of the toner.

The crystalline polyester is obtained by polycondensing an alcohol component and a carboxylic acid component, and it is preferable that the crystalline polyester is obtained by polycondensing an alcohol component containing an aliphatic diol having from 6 to 12 carbon atoms and a carboxylic acid component.

It is preferable that the alcohol component of the crystalline polyester contains an aliphatic diol having from 6 to 12 carbon atoms, and preferably from 9 to 12 carbon atoms, from the viewpoint of compatibility with the amorphous polyester.

The aliphatic diol having from 6 to 12 carbon atoms includes 1,6-hexanediol, 1,7-heptanediol, 1,8-octanediol, 1,9-nonanediol, 1,10-decanediol, 1,11-undecanediol, 1,12-dodecanediol, and the like.

The number of carbon atoms of the aliphatic diol is preferably 6 or more, more preferably 9 or more, and even more preferably 10 or more, from the viewpoint of lowering the compatibility with the amorphous polyester. In addition, the number of carbon atoms of the aliphatic diol is preferably 12 or less, from the viewpoint of appropriately compatibilizing with the amorphous polyester.

In addition, the aliphatic diol having from 6 to 12 carbon atoms preferably has a hydroxyl group at a terminal of the carbon chain, and the aliphatic diol is more preferably an α,ω-linear alkanediol, from the viewpoint of improving low-temperature fusing ability of the toner.

Although the alcohol component may contain an alcohol other than the aliphatic diol having from 6 to 12 carbon atoms, the content of the aliphatic diol having from 6 to 12 carbon atoms is preferably from 70 to 100% by mol, more preferably from 90 to 100% by mol, and even more preferably from 95 to 100% by mol, of the alcohol component.

The alcohol component other than the aliphatic diol having from 6 to 12 carbon atoms includes aliphatic diols having from 2 to 5 carbon atoms, such as ethylene glycol, 1,2-propanediol, 1,3-propanediol, and 1,4-butanediol; aromatic diols such as alkylene oxide adducts of bisphenol A; trihydric or higher polyhydric alcohols such as glycerol; and the like.

It is preferable that the carboxylic acid component of the crystalline polyester contains an aliphatic dicarboxylic acid compound having from 4 to 12 carbon atoms.

The aliphatic dicarboxylic acid compound having from 4 to 12 carbon atoms includes succinic acid (number of carbon atoms: 4), suberic acid (number of carbon atoms: 8), azelaic acid (number of carbon atoms: 9), sebacic acid (number of carbon atoms: 10), 1,10-decanedicarboxylic acid (number of carbon atoms: 12), a succinic acid having an alkyl group or an alkenyl group in its side chain, acid anhydrides thereof, alkyl esters having from 1 to 3 carbon atoms, and the like. In the present invention, the carboxylic acid compound includes not only free acids but also anhydrides that decompose during the reaction to form an acid, and alkyl esters having from 1 to 3 carbon atoms. Here, the number of carbon atoms of the alkyl group of the alkyl ester moiety is not included in the number of a chained hydrocarbon group.

The chained hydrocarbon group in the aliphatic dicarboxylic acid compound may be linear or branched, and the number of carbon atoms of the aliphatic dicarboxylic acid compound is preferably 6 or more, and more preferably 10 or more. In addition, the number of carbon atoms is preferably 11 or less, from the viewpoint of appropriately compatibilizing with the amorphous polyester. In addition, it is preferable that the aliphatic dicarboxylic acid compound is a saturated aliphatic dicarboxylic acid compound, from the viewpoint of pulverizability of the toner.

The content of the aliphatic dicarboxylic acid compound having from 4 to 12 carbon atoms is preferably 70 mol or more, and more preferably 80 mol or more, based on 100 mol of the alcohol component, from the viewpoint of heat-resistant storage property. In addition, the content of the aliphatic dicarboxylic acid compound is preferably 100 mol or less, and more preferably 96 mol or less, from the viewpoint of low-temperature fusing ability.

Although the carboxylic acid component may contain a carboxylic acid compound other than the aliphatic dicarboxylic acid compound having from 4 to 12 carbon atoms, the content of the aliphatic dicarboxylic acid compound having from 4 to 12 carbon atoms is preferably from 85 to 100% by mol, more preferably from 87 to 100% by mol, and even more preferably from 90 to 100% by mol, of the carboxylic acid component.

It is preferable that the carboxylic acid component contains an aliphatic monocarboxylic acid compound having from 8 to 24 carbon atoms, from the viewpoint of pulverizability of the toner.

The aliphatic monocarboxylic acid compound having from 8 to 24 carbon atoms includes stearic acid, capric acid, lauric acid, myristic acid, palmitic acid, arachidic acid, behenic acid, lignoceric acid, and the like, among which stearic acid is preferred.

The content of the aliphatic monocarboxylic acid compound having from 8 to 24 carbon atoms is preferably from 5 to 30% by mol, and more preferably from 10 to 20% by mol, of the carboxylic acid component.

Other carboxylic acid compounds include aromatic dicarboxylic acid compounds such as terephthalic acid and isophthalic acid; aliphatic dicarboxylic acid compounds having from 2 to 7 carbon atoms; tricarboxylic or higher polycarboxylic acid compounds such as trimellitic acid and pyromellitic acid; and the like.

Here, the crystallinity of the resin is expressed by a crystallinity index defined by a value of a ratio of a softening point to a highest temperature of endothermic peak determined by a differential scanning calorimeter, i.e. softening point/highest temperature of endothermic peak. The crystalline resin is a resin having a crystallinity index of from 0.6 to 1.4, preferably from 0.7 to 1.2, and more preferably from 0.9 to 1.2, and the amorphous resin is a resin having a crystallinity index exceeding 1.4 or less than 0.6. The crystallinity of the resin can be adjusted by the kinds of the raw material monomers and ratios thereof, production conditions, e.g., reaction temperature, reaction time, cooling rate, and the like. Here, the highest temperature of endothermic peak refers to a temperature of the peak on the highest temperature side among endothermic peaks observed. When a difference between the highest temperature of endothermic peak and the softening point is within 20° C., the highest temperature of endothermic peak is defined as a melting point. When the difference between the highest temperature of endothermic peak and the softening point exceeds 20° C., the peak is ascribed to a glass transition.

The polycondensation reaction of the alcohol component and the carboxylic acid component can be carried out by polycondensing the components in an inert gas atmosphere at a temperature of from 200° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The amount of the esterification catalyst is preferably from 0.01 to 1.5 parts by mass, and more preferably from 0.1 to 1.0 part by mass, based on 100 parts by mass of a total amount of the alcohol component and the carboxylic acid component. The esterification promoter includes gallic acid, and the like. The amount of the esterification promoter is preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The amount of the polymerization inhibitor is preferably from 0.001 to 0.5 parts by mass, and more preferably from 0.01 to 0.1 parts by mass, based on 100 parts by mass of a total amount of the alcohol component and the carboxylic acid component.

The crystalline polyester has a softening point of preferably 65° C. or higher, and more preferably 75° C. or higher, from the viewpoint of heat-resistant storage property and pulverizability. In addition, the crystalline polyester has a softening point of preferably 120° C. or lower, and more preferably 100° C. or lower, from the viewpoint of low-temperature fusing ability.

In addition, the crystalline polyester has a softening point that is lower than a softening point of the amorphous polyester, from the viewpoint of low-temperature fusing ability, and a difference therebetween is preferably 20° C. or more, and more preferably from 20 to 40° C. Here, the difference with the softening point of the amorphous polyester refers to a difference with a weighted average softening point when the amorphous polyester is composed of plural resins.

The crystalline polyester has a melting point of preferably 60° C. or higher, and more preferably 75° C. or higher, from the viewpoint of heat-resistant storage property. In addition, the crystalline polyester has a melting point of preferably 100° C. or lower, and more preferably 90° C. or lower, from the viewpoint of low-temperature fusing ability.

It is preferable that the resin binder composition for use in a toner of the present invention contains a crystalline polyester in an amount from 0.3 to 2.5 times the mass of a component derived from the polyethylene terephthalate in the amorphous polyester. In the resin composition, since a polyethylene terephthalate moiety in a block form is contained in nearly the same amount as the crystalline polyester, a vast number of crystal nuclei can be formed. When the content of the crystalline polyester is less than 0.3 times the mass of the component derived from the polyethylene terephthalate in the amorphous polyester, the amount of the crystalline polyester would be small, so that it is likely to worsen the low-temperature fusing ability of the resulting toner. Further, crystals of the crystalline polyesters are less likely to be formed, and perhaps act as a plasticizer of the resin composition, so that heat-resistant storage property of the toner is likely to be worsened. On the other hand, when the content of the crystalline polyester exceeds 2.5 times the mass of the component derived from the polyethylene terephthalate in the amorphous polyester, the amount of the component derived from the polyethylene terephthalate would be small, and the crystal nuclei would be reduced, so that the crystals obtained would become coarse, and perhaps are more likely to be precipitated on a toner surface, whereby durability of the resulting toner is likely to be worsened.

The content of the crystalline polyester is preferably 0.3 times the mass or more, more preferably 0.4 times the mass or more, even more preferably 0.5 times the mass or more, even more preferably 1.0 time the mass or more, even more preferably 1.2 times the mass or more, and even more preferably 1.5 times the mass or more, of the component derived from the polyethylene terephthalate in the amorphous polyester, from the viewpoint of low-temperature fusing ability and heat-resistant storage property of the resulting toner. In addition, the content of the crystalline polyester is preferably 2.5 times the mass or less, more preferably 2.2 times the mass or less, even more preferably 2.0 times the mass or less, even more preferably 1.9 times the mass or less, and even more preferably 1.8 times the mass or less, of the component derived from the polyethylene terephthalate, from the viewpoint of durability of the resulting toner.

A mass ratio of the amorphous polyester to the crystalline polyester, i.e. the amorphous polyester/the crystalline polyester, is preferably from 65/35 to 97/3, more preferably from 70/30 to 95/5, and even more preferably from 80/20 to 90/10, from the viewpoint of low-temperature fusing ability and heat-resistant storage property.

It is preferable that the resin binder composition for use in a toner of the present invention is obtained by a method including the steps of:

(1) polycondensing an alcohol component, a carboxylic acid component, and polyethylene terephthalate to provide an amorphous polyester; and (2) mixing at least the amorphous polyester obtained in the step (1) and a crystalline polyester.

The toner for electrostatic image development containing a resin binder composition of the present invention can satisfy low-temperature fusing ability with heat-resistant storage property and durability. Here, as mentioned above, those obtained in the step of mixing an amorphous polyester and a crystalline polyester may be used as the resin binder composition of the present invention, or each of the resins may be directly subject to mixing of raw materials during the production of a toner.

The toner of the present invention may be used together with a known resin other than the resin binder composition of the present invention, within the range that would not hamper the effects of the present invention. The content of the resin binder composition of the present invention is preferably from 90 to 100% by mass, more preferably from 93 to 100% by mass, and even more preferably from 95 to 100% by mass, of the resin binder.

The toner of the present invention may contain an additive such as a colorant, a releasing agent, a charge control agent, a charge control resin, a magnetic particulate, a fluidity improver, an electric conductivity modifier, a reinforcing filler such as a fibrous material, an antioxidant, or a cleanability improver, and it is preferable that the toner contains a colorant, a releasing agent, and a charge control agent.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazo yellow, or the like can be used. The toner of the present invention may be any of black toners and color toners. From the viewpoint of improving optical density and low-temperature fusing ability of the toner, the content of the colorant is preferably 1 part by mass or more, and more preferably 2 parts by mass or more, and the content is preferably 40 parts by mass or less, and more preferably 10 parts by mass or less, based on 100 parts by mass of the resin binder.

The releasing agent includes aliphatic hydrocarbon waxes such as low-molecular weight polypropylenes, low-molecular weight polyethylenes, low-molecular weight polypropylene polyethylene copolymers, microcrystalline wax, paraffin waxes, and Fischer-Tropsch wax, and oxides thereof; ester waxes such as carnauba wax, montan wax, sazole wax, and deacidified waxes thereof; fatty acid amides; fatty acids; higher alcohols; metal salts of aliphatic acids, and the like. These releasing agents may be used alone or in a mixture of two or more kinds.

The releasing agent has a melting point of preferably from 60° to 160° C., and more preferably from 60° to 150° C., from the viewpoint of low-temperature fusing ability and offset resistance of the toner.

From the viewpoint of low-temperature fusing ability and offset resistance of the toner, and from the viewpoint of dispersibility of the releasing agent in the resin binder, the content of the releasing agent is preferably 0.5 parts by mass or more, more preferably 1 part by mass or more, and even more preferably 1.5 parts by mass or more, and the content is preferably 10 parts by mass or less, more preferably 8 parts by mass or less, and even more preferably 7 parts by mass or less, based on 100 parts by mass of the resin binder.

The charge control agent is not particularly limited, and any of positively chargeable charge control agents and negatively chargeable charge control agents may be contained.

The positively chargeable charge control agent includes Nigrosine dyes including, for example, "Nigrosine Base EX," "Oil Black BS," "Oil Black SO," "BONTRON N-01," "BONTRON N-04," "BONTRON N-07," "BONTRON N-09," "BONTRON N-11," hereinabove commercially available from Orient Chemical Industries Co., Ltd., and the like; triphenylmethane-based dyes containing a tertiary amine as a side chain; quaternary ammonium salt compounds including, for example, "BONTRON P-51," commercially available from Orient Chemical Industries Co., Ltd., and cetyltrimethylammonium bromide, "COPY CHARGE PX VP435," commercially available from Clariant Ltd., and the like; polyamine resins including, for example, "AFP-B" commercially available from Orient Chemical Industries Co., Ltd., and the like; imidazole derivatives including, for example, "PLZ-2001," "PLZ-8001," hereinabove commercially available from Shikoku Chemicals Corporation, and the like; styrene-acrylic resins including, for example, "FCA-701PT," commercially available from FUJIKURAKASEI CO., LTD., and the like.

The negatively chargeable charge control agent includes metal-containing azo dyes including, for example, "VARIFAST BLACK 3804," "BONTRON S-31," "BONTRON S-32," "BONTRON S-34," "BONTRON S-36," hereinabove commercially available from Orient Chemical Industries Co., Ltd., "AIZEN SPILON BLACK TRH," "T-77," hereinabove commercially available from Hodogaya Chemical Co., Ltd., and the like; metal compounds of benzilic acid compound including, for example, "LR-147," "LR-297," hereinabove commercially available from Japan Carlit Co., Ltd., and the like; metal compounds of salicylic acid compound including, for example, "BONTRON E-81," "BONTRON E-84," "BONTRON E-88," "E-304," hereinabove commercially available from Orient Chemical Industries Co., Ltd., "TN-105," commercially available from Hodogaya Chemical Co., Ltd., and the like; copper phthalocyanine dyes; quaternary ammonium salts including, for example, "COPY CHARGE NX VP434," commercially available from Clariant Ltd., nitroimidazole derivatives, and the like; organometallic compounds including, for example, "TN105," commercially available from Hodogaya Chemical Co., Ltd., and the like.

The content of the charge control agent is preferably 0.01 parts by mass or more, more preferably 0.3 parts by mass or more, even more preferably 0.5 parts by mass or more, and even more preferably 1 part by mass or more, and preferably 10 parts by mass or less, more preferably 5 parts by mass or less, even more preferably 3 parts by mass or less, and even more preferably 2 parts by mass or less, based on 100 parts by mass of the resin binder, from the viewpoint of triboelectric stability of the toner.

The toner for electrostatic image development of the present invention may be produced by subjecting a previously prepared resin binder composition of the present invention to a process for producing a toner, and it is preferable that the toner is produced by a method including subjecting the above-mentioned components including the amorphous polyester and the crystalline polyester mentioned above contained in the resin binder composition of the present invention to a process for producing a toner, specifically, a method including the steps of:

(1) polycondensing an alcohol component, a carboxylic acid component, and a polyethylene terephthalate to provide an amorphous polyester; and
(2) subjecting components including the amorphous polyester obtained in the step (1) and a crystalline polyester to a process for producing a toner.

It is preferable that the method for producing a toner of the present invention includes the steps of:

(1) polycondensing an alcohol component, a carboxylic acid component, and a polyethylene terephthalate to provide an amorphous polyester; and
(2) mixing at least the amorphous polyester obtained in the step (1) and a crystalline polyester in an amount of from 0.3 to 2.5 times the mass of a component derived from the polyethylene terephthalate in the amorphous polyester.

In addition, the method for producing a toner of the present invention includes the steps of (1) polycondensing an alcohol component, a carboxylic acid component, and a polyethylene terephthalate to provide an amorphous polyester; and (2) mixing at least the amorphous polyester obtained in the step (1) and a crystalline polyester, and it is preferable that the amount of the polyethylene terephthalate in the above step (1) is from 5 to 50% by mass, of a total amount of the alcohol component, the carboxylic acid component, and the polyethylene terephthalate, and that a mass ratio of the amorphous polyester to the crystalline polyester in the above step (2), i.e. the amorphous polyester/the crystalline polyester, is preferably from 65/35 to 97/3.

It is preferable that the method for producing a toner of the present invention includes the step (2) of mixing the amorphous polyester and a crystalline polyester in an amount of from 0.3 to 2.5 times the mass of a component derived from the polyethylene terephthalate in the amorphous polyester. In the toner of the present invention, since a polyethylene terephthalate moiety in a block form is contained in nearly the same amount as the crystalline polyester, a vast number of crystal nuclei can be formed. When the amount of the crystalline polyester used is less than 0.3 times the mass of the component derived from the polyethylene terephthalate in the amorphous polyester, the amount of the crystalline polyester would be small, so that it is likely to worsen the low-temperature fusing ability of the resulting toner. Further, crystals of the crystalline polyesters are less likely to be formed, and perhaps act as a plasticizer of the toner, so that heat-resistant storage property of the toner is likely to be worsened. On the other hand, when the amount of the crystalline polyester used exceeds 2.5 times the mass of the component derived from the polyethylene terephthalate in the amorphous polyester, the amount of the component derived from the polyethylene terephthalate would be small, and the crystal nuclei would be reduced, so that the crystals obtained would become coarse, and perhaps are more likely to be precipitated on a toner surface, whereby durability of the resulting toner is likely to be worsened.

The amount of the crystalline polyester used in the step (2) is preferably 0.3 times the mass or more, more preferably 0.4 times the mass or more, even more preferably 0.5 times the mass or more, even more preferably 1.0 time by mass or more, even more preferably 1.2 times the mass or more, and even more preferably 1.5 times the mass or more, of the component derived from polyethylene terephthalate in the amorphous polyester, from the viewpoint of low-temperature fusing ability and heat-resistant storage property of the resulting toner. In addition, the amount of the crystalline polyester used is preferably 2.5 times the mass or less, more preferably 2.2 times the mass or less, even more preferably 2.0 times the mass or less, even more preferably 1.9 times the mass or less, and even more preferably 1.8 times the mass or less, of the component derived from polyethylene terephthalate in the amorphous polyester, from the viewpoint of durability of the resulting toner.

As a process for producing a toner, any of conventionally known methods such as a melt-kneading method, an emulsion aggregation method, an emulsion phase-inversion method, and a polymerization method may be employed. As the method for producing a toner, a melt-kneading method and an emulsion aggregation method are preferred. By employing a melt-kneading method or an emulsion aggregation method, the crystalline polyester and the amorphous polyester are homogeneously mixed and melted, so that it is considered that the effects of the present invention can be efficiently exhibited.

Among them, a pulverized toner produced by the melt-kneading method is preferable, from the viewpoint of productivity and colorant dispersibility.

In the case of a pulverized toner produced by a melt-kneading method, for example, it is preferable that a toner is produced by homogeneously mixing raw materials such as a resin binder, a colorant, and a charge control agent, with a mixer such as a Henschel mixer, thereafter melt-kneading the mixture with a closed kneader, a single-screw or twin-screw extruder, an open roller-type kneader, or the like, cooling, pulverizing, and classifying the product.

In addition, in the case of a toner produced by an emulsion aggregation method, it is preferable that a toner is produced by emulsifying raw materials such as a resin binder, a colorant, and a charge control agent in an aqueous medium, optionally adding an inorganic salt to allow the mixture to aggregate, and heating the aggregated mixture to fuse, to provide toner particles, subjecting the toner particles to a liquid-solid separation and drying.

In the toner of the present invention, it is preferable to use an external additive in order to improve transferability. As the external additive, it is preferable to use fine inorganic particles. Examples of fine inorganic particles include fine particles of silica, alumina, titania, zirconia, tin oxide, and zinc oxide, and those of silica are preferred.

It is preferable that the silica is a hydrophobic silica that is hydrophobically treated, from the viewpoint of transferability of the toner.

The hydrophobic treatment agent for hydrophobically treating the surface of silica particles includes hexamethyldisilazane (HMDS), dimethyldichlorosilane (DMDS), a silicone oil, octyltriethoxysilane (OTES), methyltriethoxysilane, and the like. Among them, hexamethyldisilazane is preferred.

The average particle size of the external additive is preferably 10 nm or more, and more preferably 15 nm or more, and preferably 250 nm or less, more preferably 200 nm or less, and even more preferably 90 nm or less, from the viewpoint of triboelectric chargeability, fluidity, and transferability of the toner.

The content of the external additive is preferably 0.05 parts by mass or more, more preferably 0.1 parts by mass or more, and even more preferably 0.3 parts by mass or more, and preferably 5 parts by mass or less, and more preferably 3 parts by mass or less, based on 100 parts by mass of the toner before the treatment with the external additive.

The toner of the present invention has a volume-median particle size $D_{50}$ of preferably from 3 to 15 μm, and more preferably from 4 to 10 μm. The term "volume-median particle size $D_{50}$" as used herein means a particle size of which cumulative volume frequency calculated on a volume percentage is 50% counted from the smaller particle sizes. Also, in a case where the toner is treated with an external additive, the volume-median particle size of the toner particles before the treatment with the external additive is regarded as a volume-median particle size of the toner.

The toner of the present invention can be used as a toner for monocomponent development, or as a toner mixed with a carrier to provide a two-component developer.

With respect to the embodiments mentioned above, the present invention further discloses the following resin binder composition for use in a toner, a toner for electrostatic image development containing the resin binder composition and a method for producing a toner.

<1> A resin binder composition for use in a toner containing one or more amorphous polyesters and a crystalline polyester, wherein at least one of the amorphous polyesters is obtained by reacting an alcohol component, a carboxylic acid component, and a polyethylene terephthalate.

<2> A resin binder composition for use in a toner containing one or more amorphous polyesters and a crystalline polyester, wherein at least one of the amorphous polyesters is obtained by reacting an alcohol component, a carboxylic acid component, and a polyethylene terephthalate, and wherein the above crystalline polyester is contained in an amount of from 0.3 to 2.5 times the mass of the component derived from the polyethylene terephthalate in the above amorphous polyester.

<3> The resin binder composition for use in a toner according to the above <1> or <2>, wherein the amount of the polyethylene terephthalate is from 5 to 50% by mass of a total amount of the alcohol component, the carboxylic acid component, and the polyethylene terephthalate.

<4> The resin binder composition for use in a toner according to any one of the above <1> to <3>, wherein a mass ratio of the amorphous polyester to the crystalline polyester, i.e. the amorphous polyester/the crystalline polyester, is from 65/35 to 97/3.

<5> The resin binder composition for use in a toner according to any one of the above <1> to <4>, wherein the amorphous polyester has a softening point of from 80° to 170° C.

<6> The resin binder composition for use in a toner according to any one of the above <1> to <5>, wherein the amorphous polyester is composed of two kinds of amorphous polyesters having different softening points.

<7> The resin binder composition for use in a toner according to the above <6>, wherein the two kinds of amorphous polyesters having different softening points are an amorphous polyester having a softening point of from 80° to 110° C. and an amorphous polyester having a softening point of from 120° to 170° C.

<8> The resin binder composition for use in a toner according to any one of the above <1> to <7>, wherein the crystalline polyester has a softening point of from 65° to 120° C.

<9> The resin binder composition for use in a toner according to any one of the above <1> to <8>, wherein the crystalline polyester is obtained by reacting an alcohol component containing an aliphatic diol having from 6 to 12 carbon atoms and a carboxylic acid component.

<10> The resin binder composition for use in a toner according to any one of the above <1> to <9>, wherein the crystalline polyester is obtained by reacting an alcohol component containing an aliphatic diol having from 9 to 12 carbon atoms and a carboxylic acid component.

<11> The resin binder composition for use in a toner according to any one of the above <1> to <10>, wherein the crystalline polyester is obtained by reacting an alcohol component and a carboxylic acid component containing an aliphatic dicarboxylic acid compound having from 4 to 12 carbon atoms.

<12> The resin binder composition for use in a toner according to any one of the above <1> to <11>, wherein the alcohol component used as the raw material monomer for the amorphous polyester contains an aromatic diol in an amount of from 80 to 100% by mol.

<13> The resin binder composition for use in a toner according to the above <12>, wherein the aromatic diol is an alkylene oxide adduct of bisphenol A represented by the formula (I).

<14> The resin binder composition for use in a toner according to any one of the above <1> to <13>, wherein the crystalline polyester has a softening point that is lower than the softening point of the amorphous polyester by 20° C. or more.

<15> The resin binder composition for use in a toner according to any one of the above <1> to <14>, wherein the crystalline polyester has a melting point of from 60° to 100° C.

<16> A toner for electrostatic image development containing the resin binder composition for use in a toner as defined in any one of the above <1> to <15>.

<17> A method for producing a resin binder composition for use in a toner, including the steps of (1) polycondensing an alcohol component, a carboxylic acid component, and a polyethylene terephthalate to provide an amorphous polyester; and (2) mixing at least the amorphous polyester obtained in the step (1) and a crystalline polyester.

<18> A method for producing a resin binder composition for use in a toner, including the steps of (1) polycondensing an alcohol component, a carboxylic acid component, and a polyethylene terephthalate to provide an amorphous polyester; and (2) mixing at least the amorphous polyester obtained in the step (1) and a crystalline polyester in an amount of from 0.3 to 2.5 times the mass of a component derived from the polyethylene terephthalate in the amorphous polyester.

<19> A method for producing a resin binder composition for use in a toner, including the steps of (1) polycondensing an alcohol component, a carboxylic acid component, and a polyethylene terephthalate to provide an amorphous polyester; and (2) mixing at least the amorphous polyester obtained in the step (1) and a crystalline polyester, wherein the amount of the polyethylene terephthalate in the above step (1) is from 5 to 50% by mass, of a total amount of the alcohol component, the carboxylic acid component, and the polyethylene terephthalate, and wherein a mass ratio of the amorphous polyester to the crystalline polyester in the above step (2), i.e. the amorphous polyester/the crystalline polyester, is from 65/35 to 97/3.

<20> The method for producing a resin binder composition for use in a toner according to the above <17> to <19>, wherein the temperature during the polycondensation reaction is from 200° to 250° C.

<21> The method for producing a resin binder composition for use in a toner according to any one of the above <17> to <20>, wherein the polycondensation reaction is carried out in the presence of a tin catalyst or a titanium catalyst.

<22> The method for producing a resin binder composition for use in a toner according to the above <21>, wherein the tin catalyst is a tin(II) compound without containing a Sn—C bond.

EXAMPLES

The following examples further describe and demonstrate embodiments of the present invention. The examples are given solely for the purposes of illustration and are not to be construed as limitations of the present invention.

[Softening Point Tm of Resin]

The softening point refers to a temperature at which half of the sample flows out, when plotting a downward movement of a plunger of a flow tester "CFT-500D", commercially available from Shimadzu Corporation, against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Highest Temperature of Endothermic Peak of Resin]

Measurements are taken using a differential scanning calorimeter "Q-100," commercially available from TA Instruments, Japan, by weighing out a 0.01 to 0.02 g sample on an aluminum pan, cooling the sample from room temperature to 0° C. at a cooling rate of 10° C./min, and keeping at 0° C. for one minute. Thereafter, the measurements are taken while heating the sample at a rate of 50° C./min. Of the endothermic peaks observed, a temperature at top of the peak of the highest temperature side is defined as a highest temperature of endothermic peak.

[Glass Transition Temperature of Resin]

The glass transition temperature refers to a temperature of an intersection of the extension of the baseline of equal to or lower than the highest temperature of the endothermic peak and the tangential line showing the maximum inclination between the rise of the peak and the top of the peak, wherein the endothermic peaks are measured by raising the temperature of a 0.01 to 0.02 g sample weighed out on an aluminum pan to 200° C., cooling the sample from that temperature to 0° C. at a cooling rate of 10° C./min, and thereafter raising the temperature of the sample at a heating rate of 10° C./min, using a differential scanning calorimeter "DSC 210," commercially available from Seiko Instruments Inc.

[Acid Value of Resin]

The acid value is measured in accordance with a method as prescribed in JIS K0070 except that only the determination solvent is changed from a mixed solvent of ethanol and ether as prescribed in JIS K0070 to a mixed solvent of acetone and toluene in a volume ratio of acetone:toluene=1:1.

[Number-Average Molecular Weight Mn of Polyethylene Terephthalate]

The number-average molecular weight is obtained by measuring a molecular weight distribution in accordance with a gel permeation chromatography (GPC) method as shown by the following method.

(1) Preparation of Sample Solution

The sample is dissolved in chloroform at 40° C., so as to have a concentration of 0.5 g/100 ml. Next, this solution is filtered with a fluororesin filter "DISMIC-25JP," commercially available from ADVANTEC, having a pore size of 0.2 μm, to remove insoluble components, to provide a sample solution.

(2) Measurement of Molecular Weight

The measurement is taken with the following measurement instrument and analytical column by allowing chloroform to flow through a column as an eluent at a flow rate of 1 ml per minute, stabilizing the column in a thermostat at 40° C., and injecting 100 μl of a sample solution to the column. The molecular weight of the sample is calculated based on the previously drawn calibration curve. At this time, a calibration curve is drawn from several kinds of monodisperse polystyrenes, commercially available from Tosoh Corporation, A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$) as standard samples.

Measurement Apparatus: HLC-8220GPC, Commercially Available from Tosoh Corporation Analyzing Column; GMBLX+G3000HXL, Commercially Available from Tosoh Corporation

[Melting Point of Releasing Agent]

A highest temperature of peak of the heat of fusion is measured with a differential scanning calorimeter "DSC 210," commercially available from Seiko Instruments, Inc., obtained by weighing out a 0.01 to 0.02 g sample on an aluminum pan, raising the temperature of the sample to 200° C., cooling the sample from that temperature to 0° C. at a cooling rate of 10° C./min, and thereafter raising the temperature of the sample at a heating rate of 10° C./min, and is referred to as a melting point.

[Average Particle Size of External Additive]

An average particle size refers to a number-average particle size, which is an average of 500 particles of an external additive measured from a photograph taken with a scanning electron microscope (SEM). When the particles have length and breadth, a length is employed.

[Volume-Median Particle Size $D_{50}$ of Toner]

Measuring Apparatus: Coulter Multisizer II, commercially available from Beckman Coulter, Inc.

Aperture Diameter: 50 μm

Analyzing Software: Coulter Multisizer AccuComp Ver. 1.19, commercially available from Beckman Coulter, Inc.

Electrolytic solution: Isotone II, commercially available from Beckman Coulter, Inc.

Dispersion: EMULGEN 109P, commercially available from Kao Corporation, polyoxyethylene lauryl ether, HLB: 13.6, a 5% by mass electrolytic solution.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and the mixture is further dispersed with an ultrasonic disperser for 1 minute.

Measurement Conditions: The above dispersion and 100 ml of the above electrolytic solution are added to a beaker to adjust to a concentration at which particle sizes of 30,000 particles can be measured in 20 seconds, and thereafter the 30,000 particles are measured, and a volume-median particle size $D_{50}$ is obtained from the particle size distribution.

[Production of Resins]

Production Example 1 [Resins a1 to a5, and a7 and A1 to A3]

A 10-liter four-necked flask equipped with a dehydration tube equipped with a nitrogen inlet tube, a stirrer, and a thermocouple was charged with raw materials other than adipic acid and trimellitic anhydride as listed in Table 1, and 30 g of tin(II) 2-ethylhexanoate and 2 g of gallic acid. The contents were subjected to a polycondensation reaction at 230° C. for 6 hours under a nitrogen atmosphere. The reaction mixture was reacted at 230° C. and 8.0 kPa for 1 hour, thereafter adipic acid and trimellitic anhydride were further added thereto, and the contents were reacted at 210° C., and the reaction mixture was reacted at 10 kPa until a softening point as listed in Table 1 was reached, to provide an amorphous polyester.

Production Example 2 [Resin a6]

A 10-liter four-necked flask equipped with a nitrogen inlet tube, dehydration tube equipped with a fractional distillation tube through which hot water at 100° C. was allowed to flow, a stirrer, and a thermocouple was charged with raw materials other than adipic acid and trimellitic anhydride as listed in Table 1, and 30 g of tin(II) 2-ethylhexanoate and 2 g of gallic acid. The contents were held at a temperature of 180° C. for 1 hour, heated from 180° to 230° C. at a rate of 10° C./hour, and thereafter subjected to a polycondensation reaction at 230° C. for 6 hours. The reaction mixture was reacted at 230° C. and 8.0 kPa for 1 hour, thereafter adipic acid and trimellitic anhydride were further added thereto, the contents were reacted at 210° C., and then reacted at 10 kPa until a softening point as listed in Table 1 was reached, to provide an amorphous polyester.

Production Example 3 [Resins C1 to C5]

A 10-L four-necked flask equipped with a nitrogen inlet tube, a dehydration tube, a stirrer, and a thermocouple was charged with raw material monomers as listed in Table 2, and the contents were held at 140° C. for 6 hours, and further heated to 200° C. over 6 hours. Thereafter, the flask was charged with 20 g of tin(II) 2-ethylhexanoate and 2 g of gallic acid, and the contents were reacted at 200° C. for 1 hour, and thereafter reacted at 8.3 kPa for 1 hour, to provide a crystalline polyester.

Production Example 4 [Resin C6]

A 10-L four-necked flask equipped with a nitrogen inlet tube, a dehydration tube, a stirrer, and a thermocouple was charged with raw material monomers as listed in Table 2, and 2 g of tert-butyl catechol, and the contents were held at 140° C. for 6 hours, and then heated to 200° C. over 6 hours. Thereafter, the flask was charged with 20 g of tin(II) 2-ethylhexanoate and 2 g of gallic acid, and the contents were reacted at 200° C. for 1 hour, and thereafter reacted at 8.3 kPa for 1 hour, to provide a crystalline polyester.

TABLE 1

| | Resin a1 | | Resin a2 | | Resin a3 | | Resin a4 | | Resin a5 | |
|---|---|---|---|---|---|---|---|---|---|---|
| Amorphous Polyester | g | molar ratio | g | molar ratio | g | molar ratio | g | molar ratio | g | molar ratio |
| Raw Material Monomers for Polyester Resins (P) | | | | | | | | | | |
| Alcohol Component | | | | | | | | | | |
| BPA-PO[1)] | 4,200 | 60 | 3,000 | 30 | 2,000 | 20 | 4,200 | 60 | 4,900 | 70 |
| BPA-EO[2)] | 1,300 | 20 | 1,857 | 20 | 929 | 10 | 1,300 | 20 | 1,950 | 30 |
| Ethylene Glycol | — | — | — | — | — | — | — | — | — | — |
| Carboxylic Acid Component | | | | | | | | | | |
| Terephthalic Acid | 598 | 18 | 853 | 18 | — | — | 1,428 | 43 | 1,262 | 38 |
| Adipic Acid | 730 | 25 | — | — | 334 | 8 | — | — | 730 | 25 |
| Trimellitic Anhydride | 960 | 25 | 1,371 | 25 | 823 | 15 | 960 | 25 | 960 | 25 |
| Recycled PET (Mn: 25,000) | 768 | (20) | 2,743 | (50) | 3,840 | (70) | 768 | (20) | — | — |
| Content of Recycled PET in Raw Material Polyester Resin (% by mass) | 9.0 | | 28.8 | | 48.4 | | 9.0 | | 0 | |
| Content of Recycled PET in Polyester Resin (% by mass) | 9.5 | | 30.1 | | 49.9 | | 9.5 | | 0 | |
| Physical Properties | | | | | | | | | | |
| Softening Point, ° C. | 140.1 | | 138.6 | | 139.2 | | 136.9 | | 138.9 | |
| Highest Temperature of Endothermic Peak, ° C. | 59.3 | | 58.9 | | 61.3 | | 68.1 | | 58.2 | |
| Crystallinity Index | 2.36 | | 2.35 | | 2.27 | | 2.01 | | 2.39 | |
| Glass Transition Temperature, ° C. | 56.8 | | 55.3 | | 58.3 | | 65.8 | | 55.7 | |
| Acid Value, mgKOH/g | 25.4 | | 33.8 | | 26.7 | | 28.9 | | 26.3 | |

| | Resin a6 | | Resin a7 | | Resin A1 | | Resin A2 | | Resin A3 | |
|---|---|---|---|---|---|---|---|---|---|---|
| Amorphous Polyester | g | molar ratio | g | molar ratio | g | molar ratio | g | molar ratio | g | molar ratio |
| Raw Material Monomers for Polyester Resins (P) | | | | | | | | | | |
| Alcohol Component | | | | | | | | | | |
| BPA-PO[1)] | 4,200 | 60 | 4,900 | 70 | 4,900 | 70 | 4,200 | 60 | 2,000 | 20 |
| BPA-EO[2)] | 1,300 | 20 | 1,300 | 20 | 1,950 | 30 | 1,300 | 20 | — | — |
| Ethylene Glycol | 248 | 20 | — | — | — | — | — | — | — | — |
| Carboxylic Acid Component | | | | | | | | | | |
| Terephthalic Acid | 1,262 | 38 | 930 | 28 | 2,158 | 65 | 1,162 | 35 | — | — |
| Adipic Acid | 730 | 25 | 730 | 25 | 438 | 15 | 584 | 20 | 209 | 5 |

TABLE 1-continued

| | | | | | | | | | | |
|---|---|---|---|---|---|---|---|---|---|---|
| Trimellitic Anhydride | 960 | 25 | 960 | 25 | 115 | 3 | 384 | 10 | 384 | 7 |
| Recycled PET (Mn: 25,000) | — | — | 480 | (10) | — | — | 768 | (20) | 4,389 | (80) |
| Content of Recycled PET in Raw Material Polyester Resin (% by mass) | 0 | | 5.2 | | 0 | | 9.1 | | 62.9 | |
| Content of Recycled PET in Polyester Resin (% by mass) | 0 | | 5.5 | | 0 | | 9.5 | | 64.0 | |
| Physical Properties | | | | | | | | | | |
| Softening Point, ° C. | 136.9 | | 139.1 | | 90.3 | | 93.4 | | 87.7 | |
| Highest Temperature of Endothermic Peak, ° C. | 58.5 | | 60.1 | | 53.7 | | 53.2 | | 54.0 | |
| Crystallinity Index | 2.34 | | 2.31 | | 1.68 | | 1.76 | | 1.62 | |
| Glass Transition Temperature, ° C. | 55.7 | | 57.4 | | 50.3 | | 50.2 | | 50.3 | |
| Acid Value, mgKOH/g | 28.5 | | 24.8 | | 13.1 | | 25.6 | | 24.1 | |

Note)
The molar ratio of the recycled PET is a molar ratio calculated, assuming that the (terephthalic acid-ethylene glycol) unit is 1 mol.
[1)]Polyoxypropylene(2.2)-2,2-bis(4-hydroxyphenyl)propane
[2)]Polyoxyethylene(2.2)-2,2-bis(4-hydroxyphenyl)propane

TABLE 2

| | Resin C1 | | Resin C2 | | Resin C3 | | Resin C4 | | Resin C5 | | Resin C6 | |
|---|---|---|---|---|---|---|---|---|---|---|---|---|
| Crystalline Polyester | molar ratio | g | molar ratio | g | molar ratio | g | molar ratio | g | molar ratio | g | molar ratio | g |
| Alcohol Component | | | | | | | | | | | | |
| 1,12-Dodecanediol | 100 | 4,040 | 100 | 4,040 | — | — | — | — | 100 | 5,050 | 100 | 5,050 |
| 1,10-Decanediol | — | — | — | — | 100 | 3,480 | — | — | — | — | — | — |
| 1,6-Hexanediol | — | — | — | — | — | — | 100 | 2,950 | — | — | — | — |
| Carboxylic Acid Component | | | | | | | | | | | | |
| Sebacic Acid | 95 | 3,838 | 100 | 4,040 | 95 | 3,838 | — | — | — | — | — | — |
| Stearic Acid | 10 | 568 | — | — | 10 | 568 | 10 | 710 | 10 | 710 | 10 | 710 |
| 1,10-Decanedicarboxylic Acid | — | — | — | — | — | — | 95 | 5,463 | — | — | — | — |
| Fumaric Acid | — | — | — | — | — | — | — | — | — | — | 95 | 2,755 |
| Succinic Acid | — | — | — | — | — | — | — | — | 95 | 2,803 | — | — |
| Physical Properties | | | | | | | | | | | | |
| Softening Point, ° C. | 88.7 | | 90.3 | | 84.2 | | 75.3 | | 80.4 | | 94.5 | |
| Highest Temperature of Endothermic Peak-Melting Point, ° C. | 87.4 | | 87.8 | | 81.0 | | 70.3 | | 76.4 | | 92.1 | |
| Softening Point/Highest Temperature of Endothermic Peak | 1.01 | | 1.03 | | 1.04 | | 1.07 | | 1.05 | | 1.03 | |

[Production of Toner for Electrostatic Image Development]

Examples 1 to 13 and Comparative Examples 1 to 5

One hundred parts by mass of a resin binder prepared by mixing a crystalline polyester and amorphous polyesters as listed in Table 3, 5 parts by mass of a colorant "ECB-301," commercially available from DAINICHISEIKA COLOR & CHEMICALS MFG. CO., LTD., C. I. Pigment Blue 15:3, 1 part by mass of a negatively chargeable charge control agent "LR-147," commercially available from Japan Carlit Co., Ltd., and 2 parts by mass of a releasing agent "NP-105," commercially available from MITSUI CHEMICALS, INC., melting point: 140° C. were well stirred with a Henschel mixer. Thereafter, the mixture was melt-kneaded with a co-rotating twin-screw extruder having an entire length of a kneading member of 1,560 mm, a screw diameter of 42 mm, and a Barrel inner diameter of 43 mm. The rotational speed of the roller was 200 r/min, the heating temperature inside the roller was 120° C., the feeding rate of the mixture was 10 kg/hr, and the average residence time was about 18 seconds. The resulting kneaded mixture was pressed and cooled with a cooling roller, and thereafter subjected to a pulverization treatment with a jet mill, to provide a powder having a volume-median particle size $D_{50}$ of 6.5 μm.

To 100 parts by mass of the resulting powder were added 1.0 part by mass of external additives a hydrophobic silica "Aerosil R-972," commercially available from Nippon Aerosil Co., Ltd., average particle size: 16 nm, and 1.0 part by mass of a hydrophobic silica "SI-Y," commercially available from Nippon Aerosil Co., Ltd., average particle size: 40 nm while mixing with a Henschel mixer at 3,600 r/min for 5 minutes, to thereby carry out an external additive treatment, to provide a toner having a volume-median particle size $D_{50}$ of 6.5 μm.

Test Example 1 [Low-Temperature Fusing Ability]

The toner obtained was loaded on a copy machine "AR-505," commercially available from Sharp Corporation, to provide non-fused images of 2 cm×12 cm having an amount of toner adhesion of 0.7 mg/cm$^2$. A fusing test was conducted at each of the fusing temperatures using a copy machine "AR-505," commercially available from Sharp Corporation, a fusing device of which was modified so that fusing could be carried out offline at a fusing speed of 200 mm/sec, while sequentially raising the fusing temperature from 90° to 240° C. in an increment of 5° C. As paper to be fused, "Copybond SF-70NA," commercially available from Sharp Corporation, 75 g/m$^2$, was used.

A sand-rubber eraser of which bottom to which a load of 500 g was applied had dimensions of 15 mm×7.5 mm was moved backward and forward five times over a fused image obtained through a fusing device, and opto-reflective densities of the fixed image before and after rubbing were measured with a reflective densitometer "RD-915," commercially available from Macbeth Process Measurements Co. A temperature of a fusing roller at which a ratio of opto-reflective densities before and after rubbing, i.e. opto-reflective densities after rubbing/before rubbing, initially exceeds 70% is defined as a lowest fusing temperature. The lower the lowest fusing temperature, the more excellent the low-temperature fusing ability. The results are shown in Table 3.

Test Example 2 [Heat-Resistant Storage Property]

A cylindrical container having a radius of 12 mm was charged with 10 g of a toner, a 100 g weight was placed on top of the container, and the cylindrical container was held in environmental conditions of a temperature of 50° C. and a relative humidity of 60% for 72 hours. Three sieves, namely, from the top, a sieve A (opening: 250 μm), a sieve B (opening: 150 μm), and a sieve C (opening: 75 μm) were stacked on top of each other and set on a powder tester, commercially available from Hosokawa Micron Corporation, and 10 g of a toner was placed on the sieve A, and vibrated for 60 seconds. Each of WA (g), the mass of a toner remaining on the sieve A, WB (g), the mass of a toner remaining on the sieve B, and WC (g), the mass of a toner remaining on the sieve C, was measured. The heat-resistant storage property was evaluated on the basis of a value (α) calculated in accordance with the following formula. The more the value (α) approximates 100, the more excellent the heat-resistant storage property. The results are shown in Table 3.

$$\alpha = 100 - \frac{WA + WB \times 0.6 + WC \times 0.2}{10} \times 100$$

Test Example 3 [Durability]

Each of the toners was loaded to a nonmagnetic monocomponent developer device "OKI MICROLINE 5400," commercially available from Oki Data Corporation, and durability test was conducted at a print coverage of 5% under environmental conditions of a temperature of 32° C. and humidity of 85%. During the course of the test, black solid images were printed every 500 sheets, and the presence or absence of the lines formed on images was confirmed. Printing was halted at a point where the lines were generated over the images, and up to 9,000 sheets were printed at most. The number of printed sheets up to a point where lines were visually observed was regarded as the number of sheets at which the lines were generated due to fusion and deposition of the toner on a developer roller, and durability was evaluated. The larger the number of printed sheets, the more excellent the durability of the toner. The results are shown in Table 3.

Test Example 4 [Pulverizability]

In the processes for producing a toner of each of Examples and Comparative Examples, the resulting kneaded mixture was pressed and cooled with a cooling roller, and thereafter pulverized to an intended volume-median particle size $D_{50}$ to 6.5 μm with adjusting a pulverization pressure with an I-2 pulverizer, commercially available from Nippon Pneumatic Mfg. Co., Ltd., to provide a toner. The pulverizability was evaluated by a pulverization pressure at the time when the volume-median particle size reached 6.5 μm in accordance with the following evaluation criteria. The results are shown in Table 3. Here, the lower the pulverization pressure, the more excellent the pulverizability.

[Evaluation Criteria of Pulverizability]

A: The pulverization pressure is 0.40 Pa or more and less than 0.50 Pa;

B: The pulverization pressure is 0.50 Pa or more and less than 0.55 Pa;

C: The pulverization pressure is 0.55 Pa or more.

TABLE 3

| | Resin Binder | | | | | | | |
|---|---|---|---|---|---|---|---|---|
| | Amorphous Polyester [Amorphous PES] | | | | | | | |
| | High Tm | Amount of PET (% by mass) | Low Tm | Amount of PET (% by mass) | High Tm/Low Tm (Mass Ratio) | Amount of PET in Amorphous PES (% by mass) | Crystalline Polyester [Crystalline PES] | Amorphous PES/Crystalline PES (Mass Ratio) |
| Ex. 1 | a1 | 9.5 | A1 | 0 | 60/30 | 6.33 | C1 | 90/10 |
| Ex. 2 | a1 | 9.5 | A2 | 9.5 | 60/30 | 9.5 | C1 | 90/10 |
| Ex. 3 | a2 | 30.1 | A1 | 0 | 60/30 | 20.07 | C1 | 90/10 |
| Ex. 4 | a3 | 49.9 | A1 | 0 | 60/30 | 33.27 | C1 | 90/10 |
| Ex. 5 | a4 | 9.5 | A1 | 0 | 60/30 | 6.33 | C1 | 90/10 |
| Ex. 6 | a1 | 9.5 | A1 | 0 | 60/30 | 6.33 | C2 | 90/10 |
| Ex. 7 | a1 | 9.5 | A1 | 0 | 60/30 | 6.33 | C3 | 90/10 |
| Ex. 8 | a1 | 9.5 | A1 | 0 | 60/30 | 6.33 | C4 | 90/10 |
| Ex. 9 | a1 | 9.5 | A1 | 0 | 60/30 | 6.33 | C5 | 90/10 |
| Ex. 10 | a1 | 9.5 | A1 | 0 | 60/30 | 6.33 | C6 | 90/10 |
| Ex. 11 | a5 | 0 | A3 | 64.0 | 60/30 | 21.33 | C1 | 90/10 |
| Ex. 12 | a1 | 9.5 | — | — | 90/0 | 9.5 | C1 | 90/10 |
| Ex. 13 | a1 | 9.5 | A1 | 0 | 50/50 | 4.75 | C1 | 90/10 |
| Comp. Ex. 1 | a5 | 0 | A1 | 0 | 60/30 | 0 | C1 | 90/10 |
| Comp. Ex. 2 | a6 | 0 | A1 | 0 | 60/30 | 0 | C1 | 90/10 |

TABLE 3-continued

| | | | | | | | | |
|---|---|---|---|---|---|---|---|---|
| Comp. Ex. 3 | a1 | 9.5 | A1 | 0 | 20/70 | 2.11 | C1 | 90/10 |
| Comp. Ex. 4 | a3 | 49.9 | A3 | 64.0 | 60/30 | 54.6 | C1 | 90/10 |
| Comp. Ex. 5 | a7 | 5.5 | A1 | 0 | 60/30 | 3.67 | C1 | 90/10 |

| | Resin Binder | Evaluation of Toner | | | |
|---|---|---|---|---|---|
| | Crystalline PES/PET in Amorphous PES (Mass Ratio) | Low-Temp. Fusing Ability (° C.) | Heat-Resistant Storage Property | Durability (Sheets) | Pulverizability |
| Ex. 1 | 1.755 | 120 | 98 | 7,000 | A |
| Ex. 2 | 1.170 | 130 | 90 | 7,500 | A |
| Ex. 3 | 0.554 | 130 | 97 | 6,500 | A |
| Ex. 4 | 0.334 | 140 | 98 | 6,500 | A |
| Ex. 5 | 1.755 | 140 | 98 | 7,000 | A |
| Ex. 6 | 1.755 | 130 | 90 | 6,500 | B |
| Ex. 7 | 1.755 | 120 | 80 | 6,000 | A |
| Ex. 8 | 1.755 | 120 | 70 | 5,000 | A |
| Ex. 9 | 1.755 | 120 | 70 | 5,000 | A |
| Ex. 10 | 1.755 | 130 | 96 | 7,000 | B |
| Ex. 11 | 0.521 | 130 | 98 | 7,000 | B |
| Ex. 12 | 1.170 | 135 | 99 | 7,500 | B |
| Ex. 13 | 2.34 | 125 | 60 | 4,000 | B |
| Comp. Ex. 1 | — | 130 | 10 | 1,000 | C |
| Comp. Ex. 2 | — | 150 | 20 | 1,000 | B |
| Comp. Ex. 3 | 5.266 | 125 | 50 | 3,500 | B |
| Comp. Ex. 4 | 0.204 | 150 | 30 | 3,000 | B |
| Comp. Ex. 5 | 3.028 | 130 | 40 | 500 | B |

It can be seen from the above results that all the toners of Examples can satisfy low-temperature fusing ability with heat-resistant storage property and durability, as compared to the toners of Comparative Examples.

The resin binder composition for use in a toner of the present invention is suitably used as a resin binder composition for use in a toner used in development or the like of latent images formed in, for example, an electrophotographic method, an electrostatic recording method, an electrostatic printing method, or the like.

What is claimed is:

1. A method for producing a toner for electrostatic image development, comprising:

(1) polycondensing an alcohol component, a carboxylic acid component, and polyethylene terephthalate to obtain an amorphous polyester;

(2) combining components comprising said amorphous polyester and a crystalline polyester, to obtain a resin binder; and (3) combining said resin binder with components comprising a colorant, to obtain said toner, wherein said crystalline polyester is present in said toner in an amount of from 0.3 to 2.2 times the mass of a component derived from said polyethylene terephthalate in said amorphous polyester, and wherein said polycondensing in step (1) is carried out in the presence of a catalyst which is a tin(II) compound which does not contain a Sn—C bond or a titanium catalyst.

2. The method according to claim 1, wherein the amount of the polyethylene terephthalate is from 5 to 50% by mass of a total amount of the alcohol component, the carboxylic acid component, and the polyethylene terephthalate.

3. The method according to claim 1, wherein a mass ratio of the amorphous polyester to the crystalline polyester, i.e. the amorphous polyester/the crystalline polyester, is from 65/35 to 97/3.

4. The method according to claim 1, wherein the amorphous polyester has a softening point of from 80° to 170° C.

5. The method according to claim 1, wherein the amorphous polyester is composed of two kinds of amorphous polyesters having different softening points.

6. The method according to claim 5, wherein the two kinds of amorphous polyesters having different softening points are an amorphous polyester having a softening point of from 80° to 110° C. and an amorphous polyester having a softening point of from 120° to 170° C.

7. The method according to claim 1, wherein the crystalline polyester is obtained by polycondensing an alcohol component comprising an aliphatic diol having from 6 to 12 carbon atoms, and a carboxylic acid component.

8. The method according to claim 1, wherein the crystalline polyester is obtained by polycondensing an alcohol component and a carboxylic acid component comprising an aliphatic dicarboxylic acid compound having from 4 to 12 carbon atoms.

9. The method according to claim 1, wherein the crystalline polyester has a softening point of from 65° to 120° C.

10. The method according to claim 1, wherein the crystalline polyester has a melting point of from 60° to 100° C.

11. The method according to claim 1, wherein the alcohol component used as raw material monomers for the amorphous polyester comprises an aromatic diol in an amount of from 80 to 100% by mol.

12. The method according to claim 11, wherein the aromatic diol is an alkylene oxide adduct of bisphenol A represented by the formula (I):

(I)

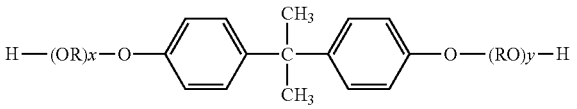

wherein RO is an alkylene oxide, wherein R is an alkylene group having 2 or 3 carbon atoms; and each of x and y is a positive number showing an average number of moles of alkylene oxide added, wherein the sum of x and y is from 1 to 16.

13. The method according to claim 1, wherein the crystalline polyester has a softening point that is lower than the softening point of the amorphous polyester by 20° C. or more.

14. The method according to claim 1, wherein the temperature during the polycondensation reaction in the step (1) is from 200° to 250° C.

15. A method for producing a resin binder composition for use in a toner for electrostatic image development, comprising:

(1) polycondensing an alcohol component, a carboxylic acid component, and polyethylene terephthalate to obtain an amorphous polyester; and (2) mixing at least said amorphous polyester and a crystalline polyester, to obtain said resin binder, wherein said crystalline polyester is mixed with said amorphous polyester in an amount of from 0.3 to 2.2 times the mass of a component derived from said polyethylene terephthalate in said amorphous polyester, and wherein said polycondensing in step (1) is carried out in the presence of a catalyst which is a tin(II) compound which does not contain a Sn—C bond or a titanium catalyst.

16. A method for producing a toner for electrostatic image development, comprising:

(1) polycondensing an alcohol component, a carboxylic acid component, and polyethylene terephthalate to obtain an amorphous polyester;

(2) combining components comprising said amorphous polyester and a crystalline polyester, to obtain a resin binder; and (3) combining said resin binder with components comprising a colorant, to obtain said toner, wherein the amount of said polyethylene terephthalate in said polycondensing is from 5 to 50% by mass of a total amount of said alcohol component, the carboxylic acid component, and said polyethylene terephthalate, and wherein a mass ratio of said amorphous polyester and said crystalline polyester in the step (2), i.e. the amorphous polyester/the crystalline polyester, is from 65/35 to 97/3, wherein said polycondensing in step (1) is carried out in the presence of a catalyst which is a tin(II) compound which does not contain a Sn—C bond or a titanium catalyst, and wherein said crystalline polyester is mixed with said amorphous polyester in an amount of from 0.3 to 2.2 times the mass of a component derived from said polyethylene terephthalate in said amorphous polyester.

17. The method according to claim 15, wherein the amorphous polyester has a softening point of from 80° to 170° C.

18. The method according to claim 15, which comprises two kinds of amorphous polyesters having different softening points.

19. The method according to claim 16, wherein the amorphous polyester has a softening point of from 80° to 170° C.

20. The method according to claim 16, which comprises two kinds of amorphous polyesters having different softening points.

* * * * *